US005400510A

United States Patent [19]

Glodowski

[11] Patent Number: 5,400,510

[45] Date of Patent: Mar. 28, 1995

[54] WINDSHIELD GLASS KNIFE BRACE

[76] Inventor: Michael J. Glodowski, 1365 Mary La., Meridian, Id. 83642

[21] Appl. No.: 171,556

[22] Filed: Dec. 20, 1993

[51] Int. Cl.[6] ..... B26B 1/04

[52] U.S. Cl. ..... 30/164.9; 30/298

[58] Field of Search ..... 30/164.9, 164.95, 286, 30/295, 296.1, 298

[56] References Cited

U.S. PATENT DOCUMENTS

| | | | |
|---|---|---|---|
| 2,470,444 | 5/1949 | Philippe | 30/164.9 |
| 2,539,601 | 1/1951 | Walker | 30/164.9 |
| 3,922,784 | 12/1975 | Prince et al. | 30/164.9 |
| 4,179,805 | 12/1979 | Yamada | 30/296.1 |
| 4,199,852 | 4/1980 | Ayers et al. | 30/296.1 |
| 4,941,261 | 7/1990 | Glenn | 30/296.1 |
| 5,275,068 | 1/1994 | Wrench | 30/296.1 |

*Primary Examiner*—Hwei Siu Payer
*Attorney, Agent, or Firm*—Frank J. Dykas; Craig M. Korfanta

[57] ABSTRACT

The invention is a brace for a windshield glass knife. In a preferred embodiment, the brace has a hollow, cylindrical sleeve which fits over the top of the handle of a conventional manual windshield glass knife. The cylindrical sleeve is rotatably attached to the first end of a rigid brace arm so that the brace arm may pivot in only a single plane containing the centerline of the knife handle when the sleeve is fitted over the handle. At the second end of the brace arm, it is connected to a forearm rest and pad. The forearm rest is a generally L- or U-shaped rest which is connected to and extends from the brace arm, with at least one side for engaging the forearm of the repairman. Optionally, on the forearm rest is a pad which increases the surface area for spreading out the forces transmitted by the brace arm to the forearm, and for resisting the twisting force in the knife handle.

With the windshield glass knife blade brace of this invention, the repairman may make a more controlled cut, and apply more force to the cutting blade without causing the blade to twist and without causing undue fatigue to the hands, wrists and forearms of the repairman.

5 Claims, 6 Drawing Sheets

WINDSHIELD GLASS KNIFE BRACE

BACKGROUND OF THE INVENTION

1. Technical Field

This invention relates generally to knife blades, and more specifically to a brace for holding a curved blade for cutting windshields out from their frames in vehicles. The invention is a brace for a windshield knife blade which distributes the forces for operating the blade from the repairman's hand and wrist down the arm to the forearm and elbow.

2. Related Art

Often it is necessary to remove the windshield from its frame in a vehicle in order to repair or replace the windshield. The current practice when installing a windshield is to bond it around its circumference to its frame with a polymer adhesive, for example, a polyurethane adhesive. Therefore, whenever it is necessary to remove this windshield it is necessary to cut through the adhesive in order to free the windshield from its frame.

In the windshield repair industry there is provided a standard manual knife for,, cutting through the windshield adhesive. One version of this knife is depicted in FIG. 1. This knife has a generally cylindrical handle which holds a generally planar, pointed blade with a nearly 90° bend in it, the bend being generally perpendicular to the width of the blade and generally perpendicular to the centerline of the handle. The thickness of the blade varies from the front to back, it being thicker in the front away from the repairman for stiffness and strength, and thinner in the back towards the repairman to allow for a sharpened, thin cutting edge there. The blade may have a short cable with a handle pivotally connected to a wider portion of the blade to assist the repairman in pulling the blade through the tough adhesive. The blade is used by pushing its pointed end through the adhesive, and then pulling it with both hands towards the repairman to cut through the adhesive.

However, during use, this prior art knife tends to twist and rotate in the repairman's hand, causing an erratic cut and discomfort for the repairman. After prolonged use, the effect of this twist and rotation is to cause fatigue and even damage to the repairman's hands, wrist and forearm.

Therefore, there is a need to eliminate the rotation and twist in the handle of the current manual knife for removing windshields. Also, there is a need to provide a more controlled cut, and to provide more force to the cutting blade making the cut, in the current manual knife for removing windshields.

DISCLOSURE OF INVENTION

The invention is a brace for a windshield glass knife. In a preferred embodiment, the brace has a hollow, cylindrical sleeve which fits over the top of the handle of a conventional manual windshield glass knife. The cylindrical sleeve is rotatably attached to the first end of a rigid brace arm so that the brace arm may pivot in only a single plane containing the centerline of the knife handle when the sleeve is fitted over the handle. At the second end of the brace arm, it is connected to a forearm rest and pad. The forearm rest is a generally L- or U-shaped rest which is connected to and extends from the brace arm, with at least one side for engaging the forearm of the repairman. Optionally, on the forearm rest is a pad which increases the surface area for spreading out the forces transmitted by the brace arm to the forearm, and for resisting the twisting force in the knife handle.

With the windshield glass knife blade brace of this invention, the repairman may make a more controlled cut, and apply more force to the cutting blade without causing the blade to twist and without causing undue fatigue to the hands, wrists and forearms of the repairman.

BEST MODE FOR CARRYING OUT INVENTION

Figure 1:
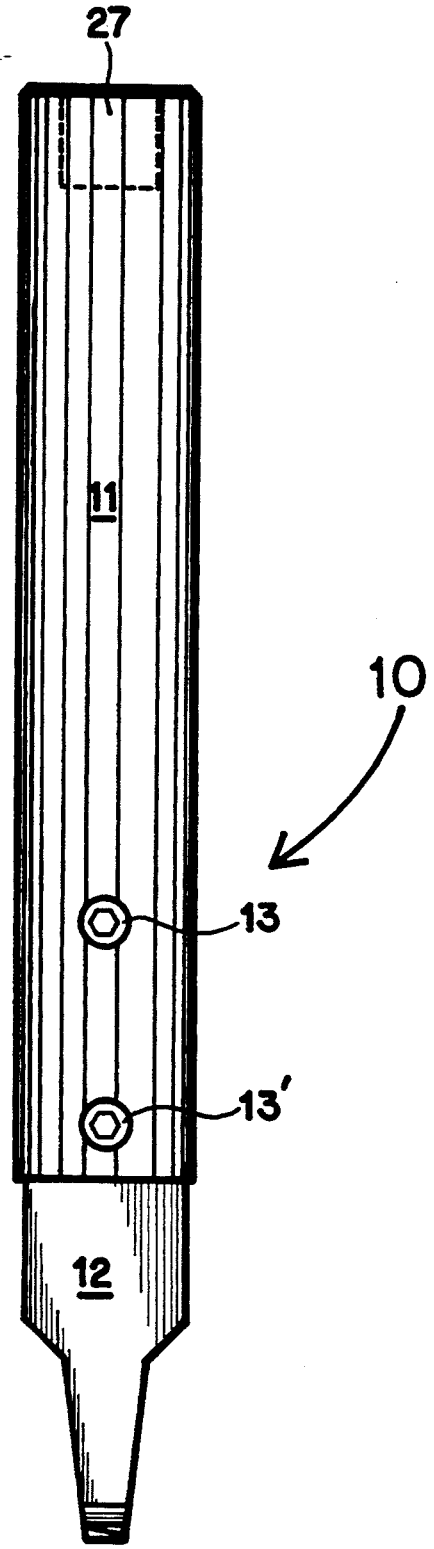
FIG. 1 is a side view similar to a conventional manual windshield glass knife blade and handle except for the top square recess.
Figure 5:
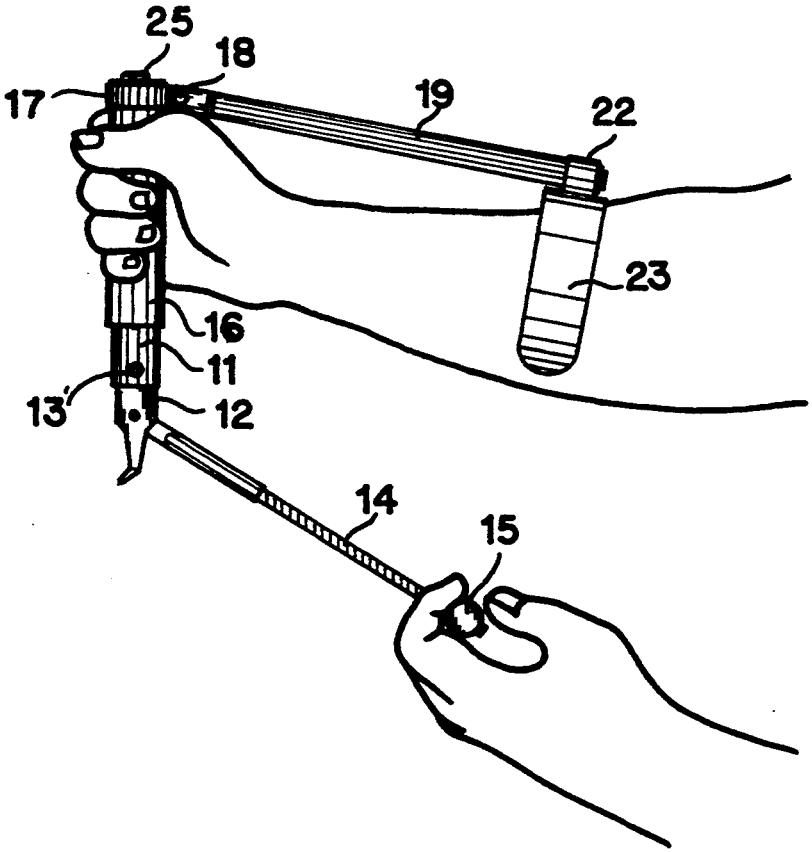
FIG. 5 is a slightly isometric view showing the brace of the present invention as depicted in FIGS. 2 and 3, and the conventional knife in use.

Referring to FIG. 1, there is depicted a side view of one embodiment of the conventional manual windshield glass knife blade and handle 10. In this embodiment, the conventional apparatus 10 has a generally cylindrical handle 11, with a curved blade 12 attached to the handle 11 by hex-head screws 13 and 13'. Blade 12 is generally planar and pointed, with a nearly 90°, rounded bend in it, the bend being generally perpendicular to the width of the blade and generally perpendicular to the centerline of the handle 11. Past the bend, the thickness of blade 12 varies from the front to the back, it being thicker in the front away from the repairman for stiffness and strength, and tapering to be thinner in the back towards the repairman to allow for a sharpened, thin cutting edge there. In operation, the repairman pushes the pointed end of blade 12 through the Windshield adhesive, and, with one hand on handle 11, pulls it towards himself to cut through the adhesive around the circumference of the windshield. Blade 12 may have a short cable 14 with a handle 15 pivotally connected to a wide portion of the blade 12 to assist the repairman in pulling the blade 12 with the other hand through the tough adhesive as depicted in FIG. 5.

Figure 2:
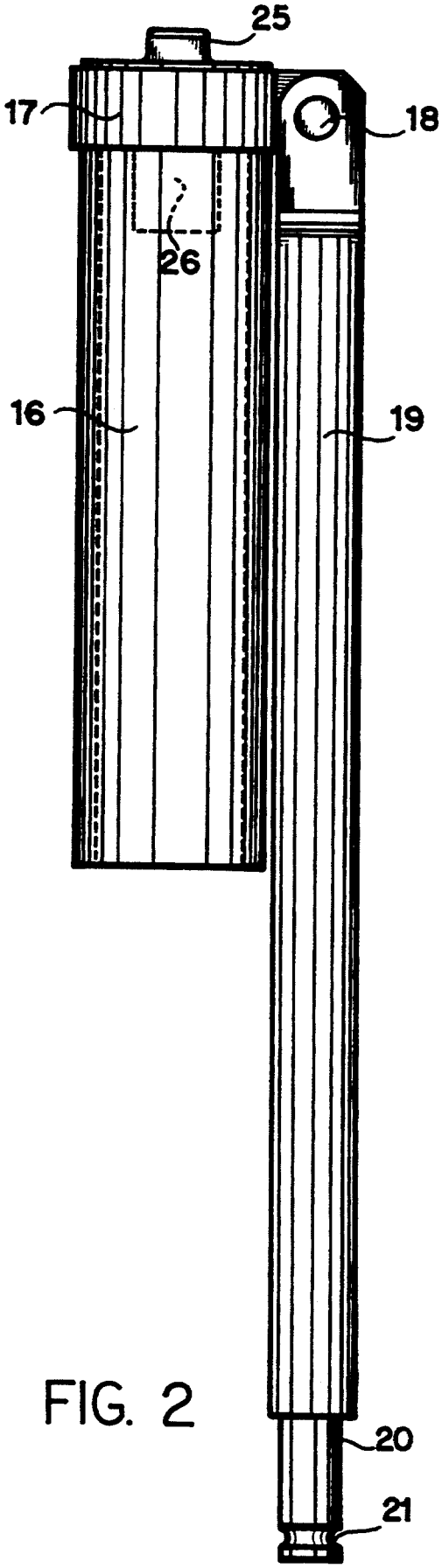
FIG. 2 is a side view of the cylindrical sleeve and brace arm portions of one embodiment of the brace of the present invention.
Figure 3:
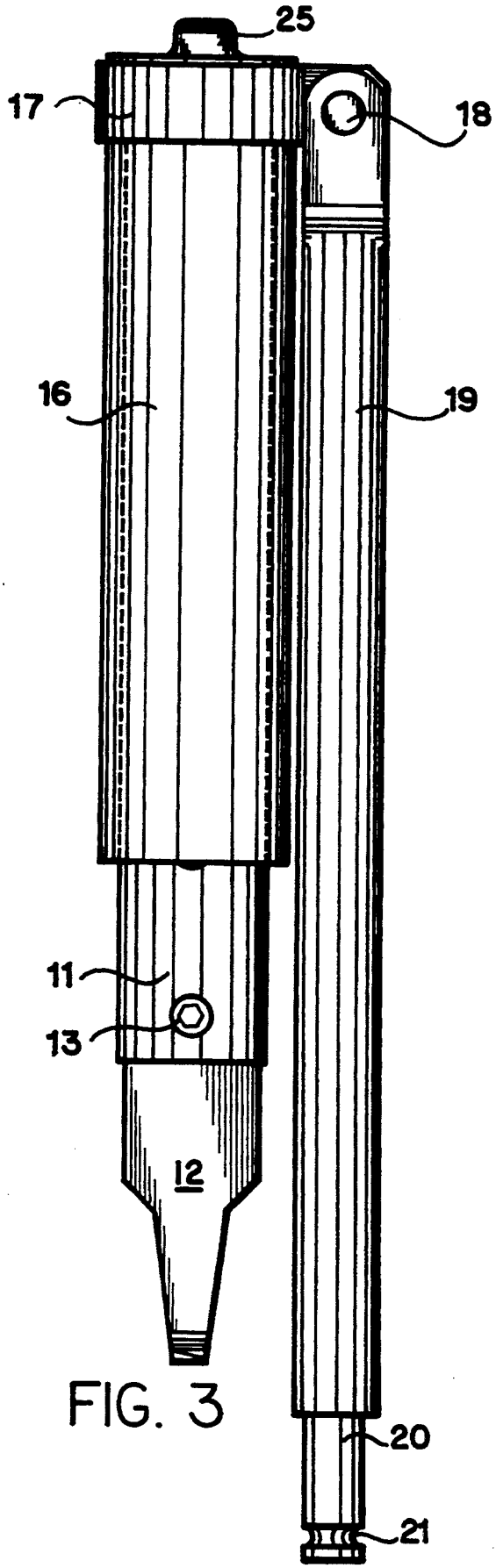
FIG. 3 is a side view of the sleeve as depicted in FIG. 2 fitted over the handle as depicted in FIG. 1.

Referring to FIGS. 2 and 3, there is depicted a side view of a portion of the brace of the present invention. Shown is cylindrical sleeve 16 which is connected via collar 17 and pivot pin 8 to rigid brace arm 19 at the arm's first end. Brace arm 19 may be made extendable via, for example, extension arm 20. In any event, at the brace arm's second end is a retraining ring 21 or some other conventional means, like a weld connection, for example, for receiving rest connector 22 which fastens forearm rest 23 and pad 24 to brace arm 19 as depicted in FIG. 4.

Figure 4:
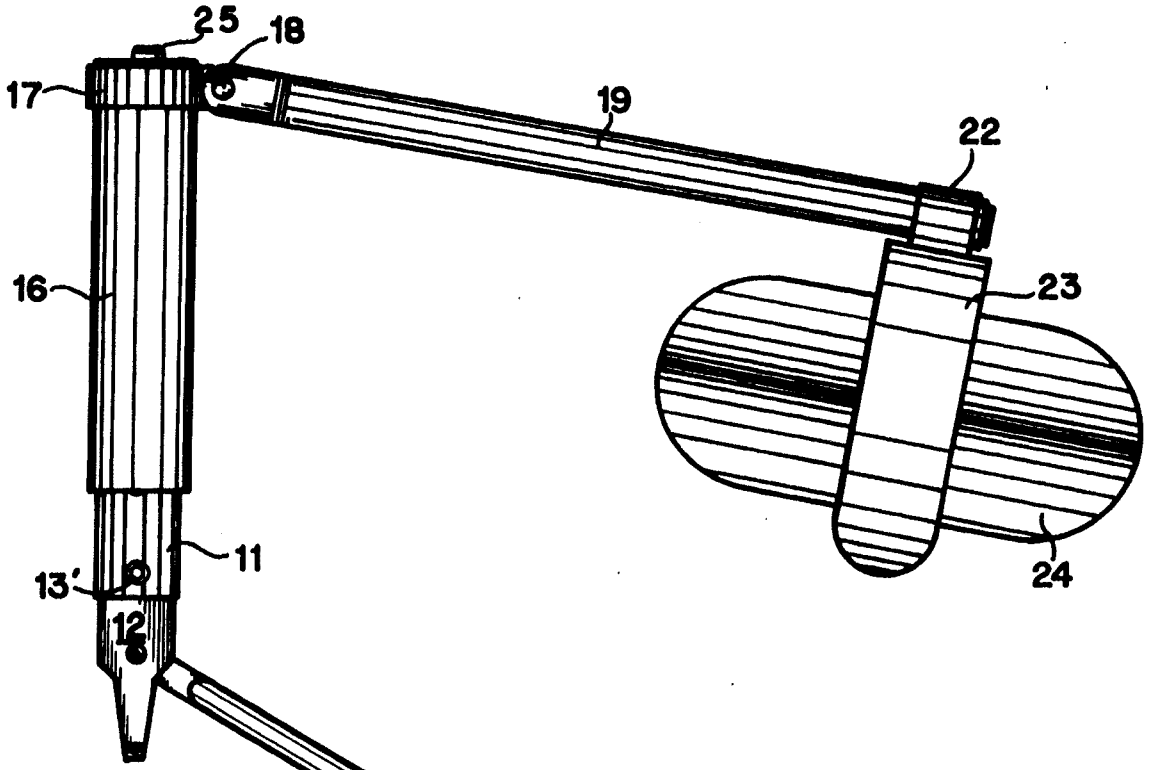
FIG. 4 is a slightly isometric side view of the entire brace of the present invention as depicted in FIG. 3 connected to the conventional knife and handle.

In use, cylindrical sleeve 16 is placed over the top of handle 11 as depicted in FIG. 4. At its inside top, sleeve 16 is machined to fit and engage securely with handle 11. In a preferred embodiment, sleeve 16 has a conventional ratchet wrench mechanism 25 at its inside top end. The ratchet mechanism 25 allows the knife handle 11 to be selectively rotated, relative to rigid brace arm 19, in one direction, but then locked in position. This way, the horizontal angle of attack of handle 11 and blade 12 may be adjusted. Also, the ratchet mechanism 25 allows the knife handle 11 to be selectively rotated in one direction, but not the other, unless the ratchet mechanism direction is switched. This way, the orientation of handle 11 and blade 12 may be adjusted to lock and resist rotation in one direction for right-handed repairmen, or in the other direction for left-handed repairmen.

In this preferred embodiment, the inside top end of sleeve 16 has a square ratchet head 26 which protrudes into the hollow interior of the sleeve, and fits and engages securely with a cooperating square recess 27 in the top end of handle 11.

Cylindrical sleeve 16 is rotatably attached to a first end of rigid brace arm 19 via collar 17 and pivot pin 18 so that the brace arm 19 may pivot in only a single plane containing the centerline of the knife handle 11 and sleeve 16. This way, the brace arm 19 may be adjusted relative to knife handle 11 and sleeve 16 to vary the vertical angle of attack by the repairman on the windshield adhesive, without permitting the handle 11 and sleeve 16 to rotate or twist in any other plane relative to the repairman's forearm.

Consequently, forces applied by the knife blade 12 and handle 11 are transmitted through sleeve 16, collar 17, brace arm 19 and forearm rest 23 and pad 24. Likewise, forces applied by the repairman's shoulders, upper arms and forearms are efficiently transferred back to the knife blade 12. This way, the repairman may make a more controlled cut, and apply more force to the blade 12, without causing the blade 12 to twist and without causing undue fatigue to the hands, wrists and forearms of the repairman.

Figure 6:
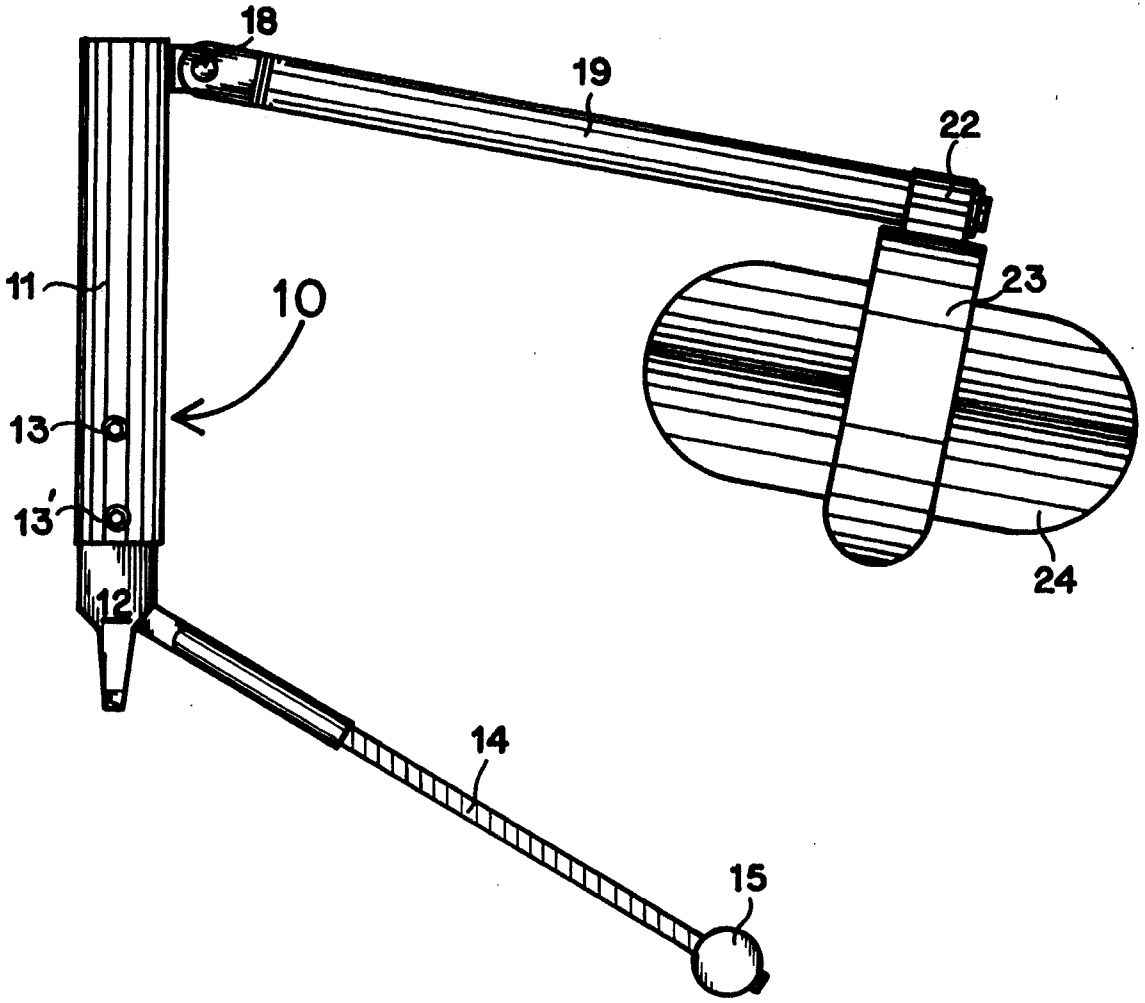
FIG. 6 is a slightly isometric view of another embodiment of the present invention.

In another embodiment of the invention, the connection between brace arm 19 and handle 11 is still pivotal, but direct, without cylindrical sleeve 16 and collar 17, but with pivot pin 18. In this embodiment, as depicted in FIG. 6, brace arm 19 is connected directly to handle 11 via pivot pin 18 in the same manner as the embodiment discussed above, and forearm rest 23 and pad 24 are connected to brace arm 19 in the same, or similar, manner as discussed above.

While there is shown and described the present preferred embodiment of the invention, it is to be distinctly understood that this invention is not limited thereto but may be variously embodied to practice within the scope of the following claims. For example, the knife and brace of this invention may be conveniently adapted to other uses, such as a knife for cutting tile or carpet or plastic sheeting.

I claim:

1. A brace in combination with a windshield glass knife, said knife comprising a handle, a blade at one end of the handle, and said brace comprising:

(a) a hollow sleeve having a centerline and adapted to fit over the other end of the handle and engage securely with the handle;

(b) a rigid brace arm having a first end and a second end, said brace arm being rotatably connected at its first end to the hollow sleeve at where the other end of the handle disposed so that the brace arm can pivot in only a single plane containing the centerline of the sleeve, and (c) a forearm rest connected to and extending from the second end of said rigid brace arm, whereby when a user grips the sleeve with his hand, said forearm rest engages the forearm of said hand.

2. The brace and knife combination of claim 1 wherein the hollow sleeve has a ratchet mechanism which allows the handle to be selectively rotated, and locked, relative to the brace arm.

3. The brace and knife combination of claim 1 further comprises a pad attached to the forearm rest to surface area available for spreading out any forces transmitted by the brace arm to the forearm of the user.

4. A windshield glass knife comprising:

(a) an elongate handle having a centerline;

(b) a blade at one end of the handle;

(c) a rigid brace arm having a first end and a second end, said brace arm being rotatably connected at its first end to the other end of the handle so that the brace arm can pivot in only a single plane containing the centerline of the handle; and (d) a forearm rest connected to and extending from the second end of said rigid brace, whereby when a user grips the handle with his hand, said forearm rest engages the forearm of said hand.

5. The knife of claim 4 further comprises a pad attached to the forearm rest to increase surface area available for spreading out any forces transmitted by the brace arm to the forearm of a person using the knife.

* * * * *